US005762139A

United States Patent [19]

Sullaway et al.

[11] Patent Number: 5,762,139

[45] Date of Patent: Jun. 9, 1998

[54] SUBSURFACE RELEASE CEMENTING PLUG APPARATUS AND METHODS

[75] Inventors: Bobby L. Sullaway; David F. Laurel, both of Duncan, Okla.; George L. Morgan, Abita Springs, La.; David D. Szarka, Duncan, Okla.

[73] Assignee: Halliburton Company, Duncan, Okla.

[21] Appl. No.: 740,904

[22] Filed: Nov. 5, 1996

[51] Int. Cl.[6] ..... E21B 33/13

[52] U.S. Cl. ..... 166/291; 166/155; 166/156

[58] Field of Search ..... 166/285, 290, 166/291, 70, 153–156

[56] References Cited

U.S. PATENT DOCUMENTS

| | | | |
|---|---|---|---|
| 3,796,260 | 3/1974 | Bradley | 166/153 |
| 3,915,226 | 10/1975 | Savage | 166/153 |
| 4,624,312 | 11/1986 | McMullin | 166/155 |
| 4,809,776 | 3/1989 | Bradley | 166/153 |
| 5,038,862 | 8/1991 | Giroux et al. | 166/154 X |
| 5,095,988 | 3/1992 | Bode | 166/291 |
| 5,178,216 | 1/1993 | Giroux et al. | 166/216 X |
| 5,314,015 | 5/1994 | Streich et al. | 166/154 X |
| 5,392,852 | 2/1995 | Laurel et al. | 166/153 |
| 5,413,172 | 5/1995 | Laurel | 166/153 |
| 5,443,122 | 8/1995 | Brisco | 166/70 X |

*Primary Examiner*—Roger J. Schoeppel

*Attorney, Agent, or Firm*—Craig W. Roddy; C. Clark Dougherty, Jr.

[57] ABSTRACT

The present invention provides an improved subsurface release cementing plug apparatus for use in a string of pipe during the cementing of the pipe in a well bore. The apparatus includes a hollow cementing plug seat member adapted to be connected in the string of pipe near the bottom thereof and a cementing plug assembly releasably connectable to a circulation tool or casing running tool in the top of the string of pipe. The cementing plug assembly includes a top cementing plug having an external annular seating surface formed thereon for sealingly engaging a top internal annular seating surface of the cementing plug seat member, and a bottom cementing plug releasably connected to the top cementing plug having an external annular seating surface formed thereon for engaging a bottom internal annular seating surface of the cementing plug seat member.

38 Claims, 7 Drawing Sheets

FIG. 6
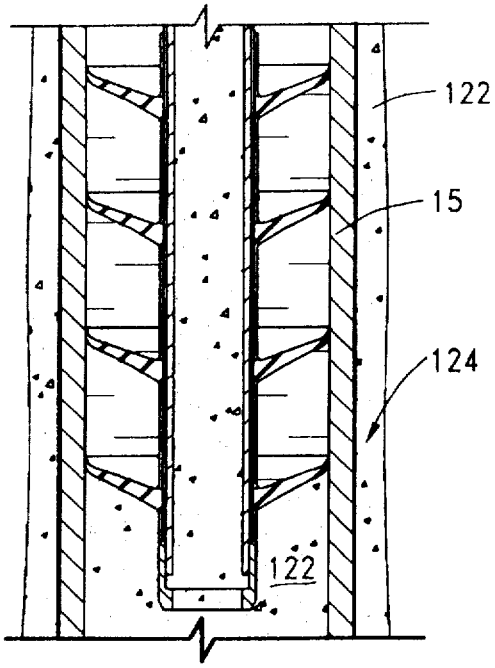
FIG. 5A
FIG. 4
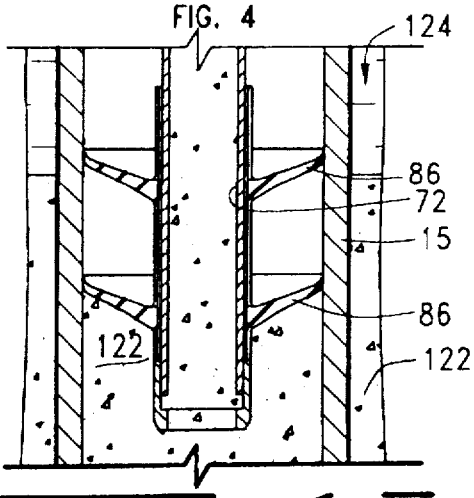
FIG. 4A
FIG. 9
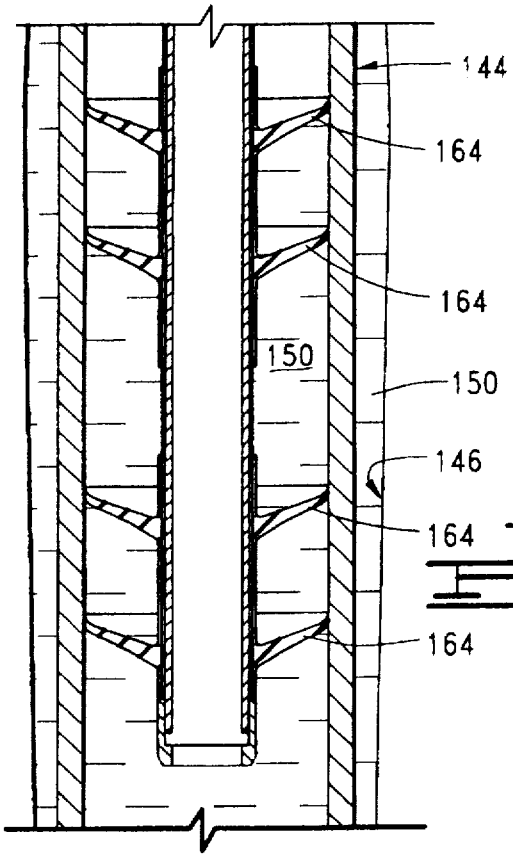
FIG. 9A
FIG. 12
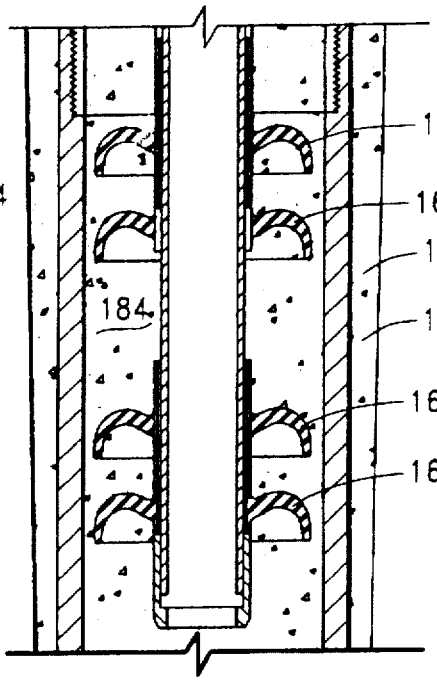
FIG. 12A

SUBSURFACE RELEASE CEMENTING PLUG APPARATUS AND METHODS

BACKGROUND OF THE INVENTION

1. Field of the Invention

This invention relates to well cementing plug assemblies and methods for use in cementing a string of pipe such as casing in a well bore.

2. Description of the Prior Art

In cementing a string of pipe in a well bore, known in the art as primary cementing, a cement slurry is pumped downwardly through the pipe string and then upwardly into the annulus between the pipe string and the walls of the well bore. Upon setting, the cement bonds the pipe string to the walls of the well bore and restricts fluid movement between formations penetrated by the well bore. Prior to the primary cementing operation, the pipe string to be cemented is suspended in the well bore and usually both the pipe string and well bore contain drilling fluid. In order to reduce contamination of the cement slurry at the interface between it and the drilling fluid, a cementing plug for sealingly engaging the inner surfaces of the pipe string is pumped ahead of the cement slurry whereby the cement slurry is separated from the drilling fluid as the cement slurry and drilling fluid are displaced through the pipe string. The cementing plug wipes the drilling fluid from the walls of the pipe string ahead of the cement slurry and maintains a separation between the cement slurry and the drilling fluid until the cementing plug lands on a float collar or float shoe attached to the bottom end of the pipe string.

The cementing plug which precedes the cement slurry and separates it from the drilling fluid is referred to herein as the "bottom cementing plug." When the predetermined required quantity of the cement slurry has been pumped into the pipe string, a second cementing plug, referred to herein as the "top cementing plug", is released into the pipe string to separate the cement slurry from additional drilling fluid or other fluid used to displace the cement slurry through the pipe string.

While the top and bottom cementing plugs can be released into the pipe string to be cemented in a variety of ways, it is generally the practice in cementing onshore wells to suspend the cementing plug assembly from a cement slurry and displacement fluid circulation tool sealingly disposed in the top end of the pipe string to be cemented. In offshore wells, the cementing plug assembly is connected below a casing running tool. The running tool and casing are then run into a sub-sea hanger using a drill pipe string. The cement slurry and displacement fluid are pumped through the circulation tool or the casing running tool into the pipe string by way of the cementing plug assembly.

When the bottom cementing plug lands on the float collar or float shoe attached to the bottom of the pipe string, a valve mechanism in the bottom cementing plug is opened which allows the cement slurry to proceed through the bottom cementing plug, through the float collar or float shoe and upwardly into the annulus between the pipe string and the well bore. The design of the top cementing plug is such that when it lands on the bottom cementing plug it shuts off fluid flow through the plugs which prevents the displacement fluid from entering the annulus.

After the top plug lands, the usual practice is to continue pumping the displacement fluid into the pipe string whereby the pipe string is pressured up and the pipe string and associated equipment including the pump are pressure tested for leaks or other defects. When very high pressure testing is required, the heretofore used plugs must provide a seal between the top and bottom plugs and between the bottom plug and float collar or float shoe in order to hold the pressure. This requires that the plugs be manufactured from expensive, high strength plastic materials to prevent failures of the plugs and/or the seals provided thereby. Even so, such plug and seal failures often occur. Thus, there is need for improved subsurface release cementing plug apparatus which can withstand very high pressures during pressure testing operations without the necessity of being made from expensive high strength materials.

Heretofore, different sizes of complete cementing plug assemblies have been required for use in different sizes of pipe to be cemented. Thus, there is also a need for improved cementing plug apparatus which is at least partially universal whereby the same internal components of the apparatus can be utilized regardless of the size of the pipe to be cemented.

SUMMARY OF THE INVENTION

The present invention provides improved well cementing plug apparatus and methods of cementing a pipe string in a well bore using the apparatus which meet the needs described above and overcome the deficiencies of the prior art. The improved cementing plug apparatus is basically comprised of a hollow cementing plug seat member adapted to be connected in a string of pipe near the bottom thereof which includes internal spaced apart top and bottom annular seating surfaces and a latch receiving means positioned near the top annular seating surface, the top annular seating surface being larger than the bottom annular seating surface. The apparatus also includes a cementing plug assembly which is releasably connectable to a circulation tool or casing running tool. The cementing plug assembly includes an open, selectively closable, top cementing plug having an external annular seating surface formed thereon near the lower end thereof for sealingly engaging the top internal annular seating surface of the cementing plug seat member and having latch means attached thereto for latching the top cementing plug to the seat member, and an open, selectively closable and openable, bottom cementing plug releasably connected to the top cementing plug having an external annular seating surface formed thereon near the upper end thereof for sealingly engaging the bottom internal annular seating surface of the cementing plug seat member. The portion of the bottom cementing plug below the external annular seating surface thereon is of a size and shape such that it passes through the bottom interior annular seating surface of the cementing plug seat member.

Because the top cementing plug independently lands and seals on the cementing plug seat member, it does not have to seal on the bottom plug and it is the only cementing plug which must withstand high pressures during testing. Further, only the leading portion of the top cementing plug is subjected to the high pressures. The cementing plug assembly of this invention can be operated utilizing various types of releasing plugs which function to close the cementing plugs and bring about their separate release into the pipe string being cemented. Releasing plugs which are latched in place upon landing are preferred.

The cementing plug seat member can be placed in the pipe string to be cemented at any desired location thereby improving the versatility of the cementing plug apparatus whereby it can be used in a variety of casing and liner cementing operations including liner cementing operations utilizing two cementing plugs. Further, float collars and float shoes are generally not required in the casing string to be cemented.

Methods of using the cementing plug apparatus for preforming primary cementing operations are also provided by the present invention.

It is, therefore, a general object of the present invention to provide improved well cementing plug apparatus and methods.

Other and further objects, features and advantages of the present invention will be readily apparent to those skilled in the art upon a reading of the description of preferred embodiments which follows when taken in conjunction with the accompanying drawings.

BRIEF DESCRIPTION OF THE DRAWINGS

FIG. 5 is a cross-sectional view similar to FIG. 1 showing the top cementing plug after its release.

FIG. 6 is a cross-sectional view similar to FIG. 2 showing the cementing plug seat member having both the bottom cementing plug and the top cementing plug seated therein.

DESCRIPTION OF PREFERRED EMBODIMENTS

Figure 1:
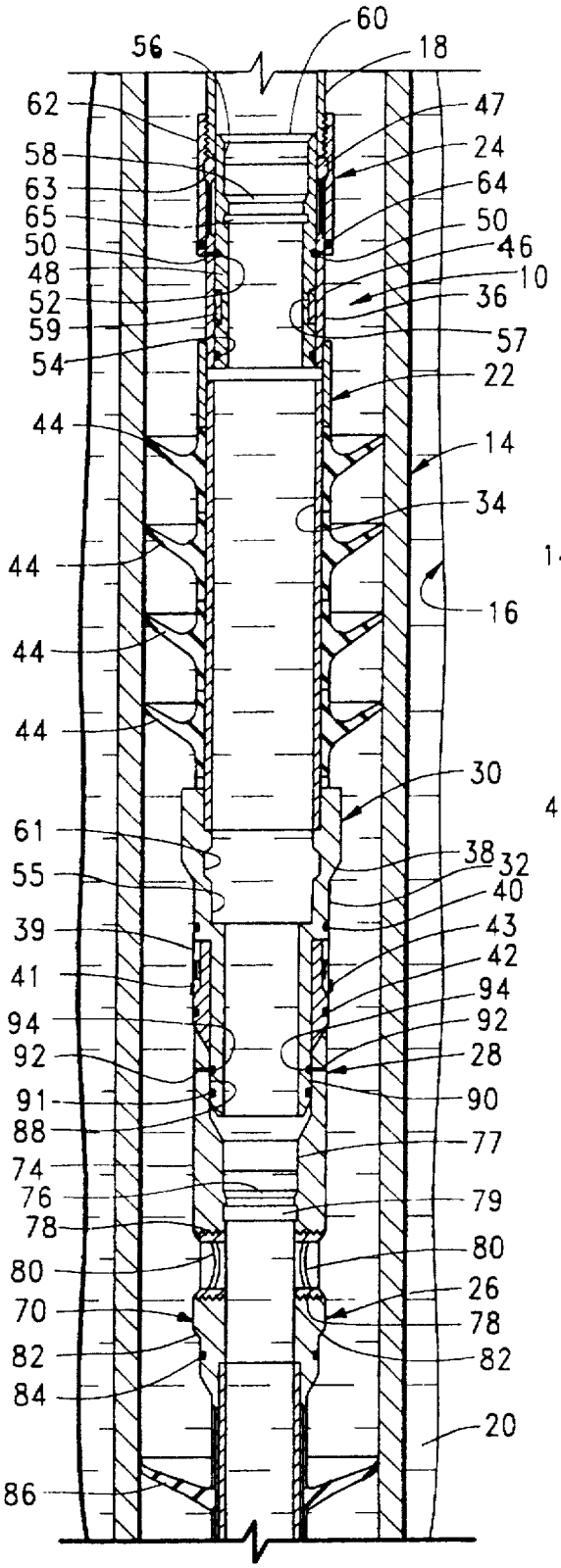
FIG. 1 is a side cross-sectional view of a well bore and a string of pipe to be cemented therein showing the cementing plug assembly of the present invention installed in its initial position in the string of pipe.
Figure 2:
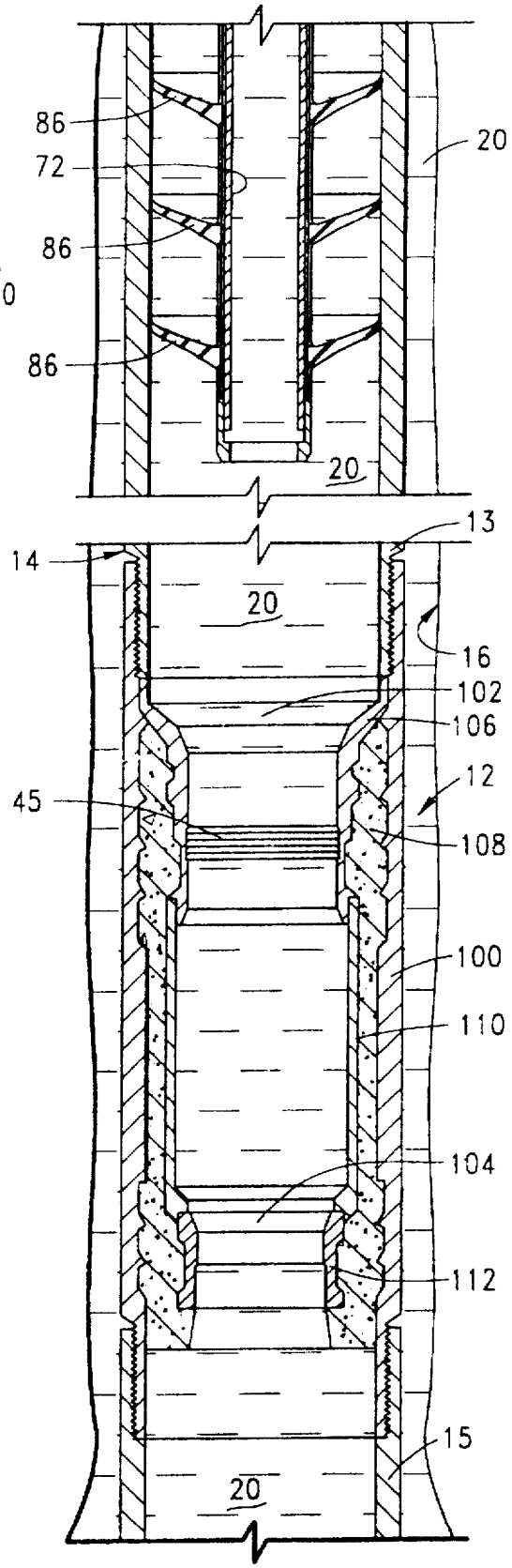
FIG. 2 is a cross-sectional view similar to FIG. 1 showing a portion of the string of pipe near the bottom end thereof having the cementing plug seat member of the present invention connected therein.

Referring now to the drawings, and particularly to FIGS. 1 and 2, the improved subsurface release cementing plug apparatus of this invention is illustrated. The apparatus is comprised of a top and bottom cementing plug assembly generally designated by the numeral 10 in FIG. 1, and a cementing plug seat member, generally designated by the numeral 12 in FIG. 2. In FIG. 1, the cementing plug assembly 10 is shown positioned within the top portion of a string of pipe 14, such as casing, which is to be cemented in a well bore 16. The cementing plug assembly 10 is in its initial position in the string of pipe 14 whereby it is releasably connected to the lower end of a circulation tool, a casing running tool or the like, designated by the numeral 18.

In FIG. 2, a portion of the string of pipe 14 near the bottom end thereof is shown in the well bore 16. The cementing plug seat member 12 of the apparatus of this invention is illustrated connected in the string of pipe 14.

As shown in FIGS. 1 and 2, both the string of pipe 14 and the well bore 16 are filled with drilling fluid 20.

Referring again to FIG. 1, the cementing plug assembly 10 is basically comprised of a top cementing plug 22 connected to the circulation tool or casing running tool 18 by a releasable connecting assembly 24, and a bottom cementing plug 26 releasably connected to the top cementing plug 22 by a releasable connecting assembly 28.

The top cementing plug 22 is comprised of a tubular body member 30 which includes a leading portion 32, an intermediate portion 34 and a tail portion 36. The leading portion 32 includes an external annular tapered seating surface 38 formed thereon for engaging a top internal annular seating surface 102 in the cementing plug seat member 12 (FIG. 2) as will be further described below. An external groove containing a seal ring, designated by the numeral 40, is positioned below the annular seating surface 38, and a second annular groove containing a seal ring, designated by the numeral 42, is positioned below the groove/seal ring 40. The groove/seal ring 40 and the groove/seal ring 42 provide seals between the tubular body member 30 of the cementing plug 22 and the cementing plug seat member 12. In addition, a collet 39 including a plurality of flexible collet fingers 41 which each have a plurality of ratchet shaped teeth providing upwardly facing shoulders thereon is attached to the leading portion 32 of the tubular body member 30 below the seating surface 38. As shown in FIG. 6 and as will be described further, the funnel shaped sleeve 106 of the cementing plug seat member 12 also includes a plurality of ratchet shaped teeth thereon which provide a plurality of downwardly facing annular shoulders 45 thereon. The downwardly facing shoulders 45 are complimentary to the shoulders 43 on the collet 39 whereby when the top cementing plug lands on the seat member 12, it is latched to the seat member 12 by the engagement of the shoulders 43 and 45.

The intermediate portion 34 of the tubular body member 30 includes a plurality of flexible wipers 44 attached thereto which extend outwardly and upwardly from the tubular body member 30. As is well understood by those skilled in the art, the flexible wipers 44 function to wipe cement slurry from the inside walls of the pipe string 14 and prevent mixing of the cement slurry with a displacement fluid following the top cementing plug 22.

The tail portion 36 of the top cementing plug 22 is a collet 46 which includes a plurality of flexible fingers having enlarged head portions 47. A releasing sleeve 48 is slidably disposed within the collet 46. At least one shear pin 50 connects between the collet 46 and releasing sleeve 48 (two are shown), e.g., the shear pin or pins 50 are engaged with the collet 46 and extend into recesses 52 in the releasing sleeve 48. An annular groove containing a seal ring, designated by the numeral 54, is disposed in the releasing sleeve 48 for providing a seal between it and the collet 46 and for providing a seal between it and an internal surface 55 of the leading portion 32 of the top cementing plug 22 as will be described further below. An annular groove 57 containing a latch ring 59 is disposed in an outer surface of the releasing sleeve 48 for latching the releasing sleeve 48 to the internal surface 55 of the leading portion 32. That is, the latch ring 59 snaps into a groove 61 in the leading portion 32 as will be described below. The top end portion of the releasing sleeve 48 includes a counterbore 56 which forms an internal annular tapered seat 58 for receiving a releasing plug (not shown) that closes the tubular body member 30 of the top cementing plug 22 and activates the cementing plug 22 for release. While various types of releasing plugs can be used such as balls and those commonly referred to as drill pipe plugs and/or darts, the releasing plug utilized with the top plug 22 is preferably of the drill pipe plug type which latches to the tubular body member 30 of the top plug 22 thereby preventing reverse flow through the top plug 22 as will be described further below. An internal annular groove 65 is provided in the tubular body member 30 for latching with the releasing plug utilized.

The collet 46 and releasing sleeve 48 form a part of the releasable connecting assembly 24 which connects the top plug 22 to the circulation tool or casing running tool 18. That is, the top portion of the collet 46 is contained within a collet retaining sleeve 62 which is connected to the tool 18. The collet retaining sleeve 62 includes an annular tapered shoulder 63 which retains the enlarged head portions 47 of the collet 46 so long as the head portions 47 are held in place by the releasing sleeve 48. The collet retaining sleeve 62 also includes a groove containing a seal ring, designated by the numeral 64, for providing a seal between the collet retaining sleeve 62 and the collet 46. The operation of the releasable connecting assembly 24 will be described further hereinbelow.

The bottom cementing plug 26 is comprised of a tubular body member 70 which is comprised of a leading portion 72 and a tail portion 74. The tail portion 74 includes an internal annular tapered seat 76 formed therein near the top thereof for receiving a releasing plug (not shown) that closes the tubular body member 70 and activates it for release. An internal annular groove 79 is provided in the tubular body member 70 for latching with the releasing plug utilized. Positioned below the annular seat 76 and annular groove 79 are one or more lateral ports 78 (two are shown), each having a rupturable member 80 sealingly disposed therein which ruptures when a predetermined differential fluid pressure is exerted thereon.

Positioned below the ports 78, and formed externally on the tubular member 70, is an external annular seating surface 82 for engaging a bottom internal annular seating surface 104 in the cementing plug seat member 12 (FIG. 2) as will be further described below. An external groove containing a seal ring, designated by the numeral 84, is positioned below the annular seating surface 82 for providing a seal between the tubular body member 70 and the cementing plug seat member 12.

The leading portion 72 of the tubular body member 70 below the annular seating surface 82 and the groove/seal ring 84 includes a plurality of flexible wipers 86 attached thereto which extend outwardly and upwardly from the tubular body member 70. As is well understood by those skilled in the art, the flexible wipers 86 function to wipe drilling fluid from the inside walls of the string of pipe 14 and prevent mixing of that fluid with a cement slurry following the bottom cementing plug 26.

The tail portion 74 of the tubular body member 70 includes a counterbore 88 for receiving a complimentary nose portion 90 on the leading portion 32 of the top cementing plug 22. The releasable connecting assembly 28 includes the tail portion 74 of the tubular body member 70 having the counterbore 88 therein, the complimentary nose portion 90 of the top cementing plug 22 and one or more shear pins 92 (two are shown) connected therebetween, e.g., the shear pin or pins 92 are engaged with the tail portion 74 of the tubular body member 70 and extend into recesses 94 in the nose portion 90 of the top cementing plug 22. An external annular groove containing a seal ring, designated by the numeral 91, is positioned in the nose portion 90 below the shear pins 92 for providing a seal between the nose portion 90 and the tail portion 74.

As will be understood by those skilled in the art, a releasable connecting assembly like the releasable connecting assembly 28 described above, which utilizes one or more shear pins to directly connect the tool 18 to the tubular body member 30 of the top cementing plug 22, may be substituted in certain applications for the collet type of releasable connecting assembly 24 described above.

Referring now to FIG. 2, the cementing plug seat member 12 is threadedly connected between two joints of the pipe making up the string of pipe 14, preferably between the bottom joint 15 and the next adjacent joint 13 thereof. The seat member 12 is comprised of a relatively short section of pipe 100 adapted to be threadedly connected between two adjacent joints of pipe in the pipe string 14. Disposed within the pipe section 100 are a pair of spaced apart top and bottom annular seating surfaces 102 and 104, respectively. The top annular seating surface 102, which is larger than the bottom annular seating surface 104, is formed by a funnel shaped insert 106 held in the pipe section 100 by a readily drillable cement composition 108 or the like. The funnel shaped sleeve 106 is made from a drillable metal such as aluminum and the annular seating surface 102 thereof is of a size which engages the external annular seating surface 38 of the top cementing plug 22 as shown in FIG. 6.

Figure 4:
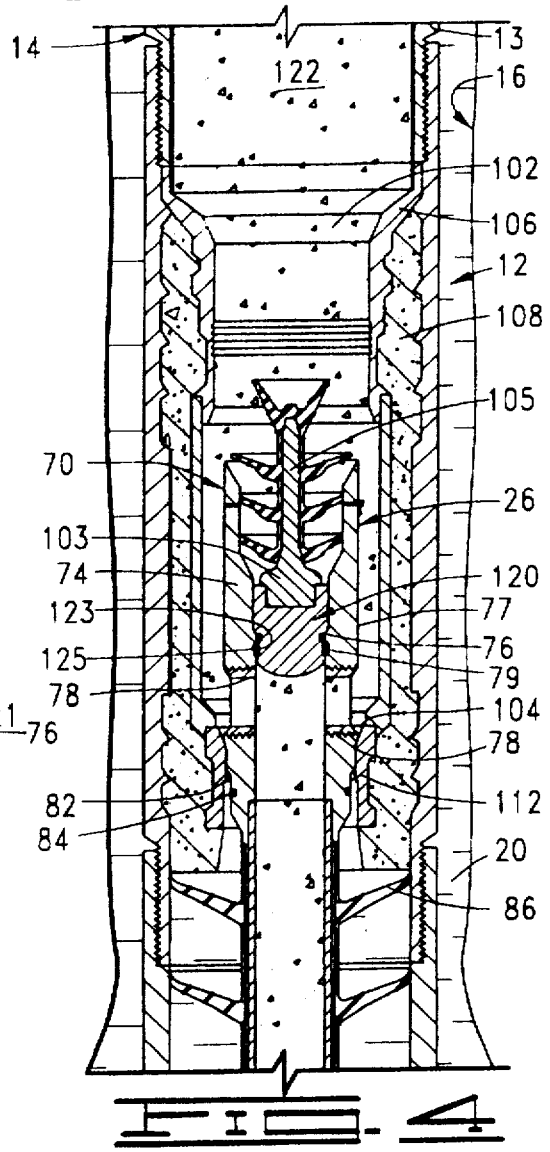
FIG. 4 is a cross-sectional view similar to FIG. 2 showing the cementing plug seat member after the bottom cementing plug has seated therein and the rupturable members thereof have been opened.
Figure 1:
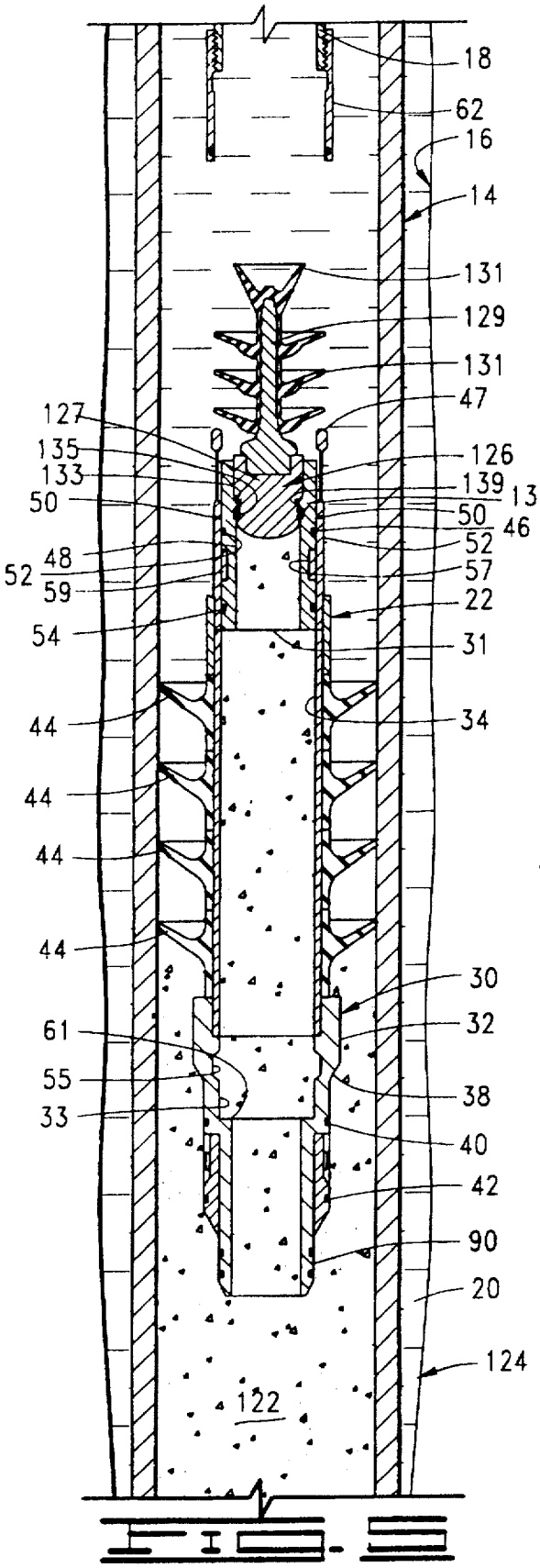
Figure 2:
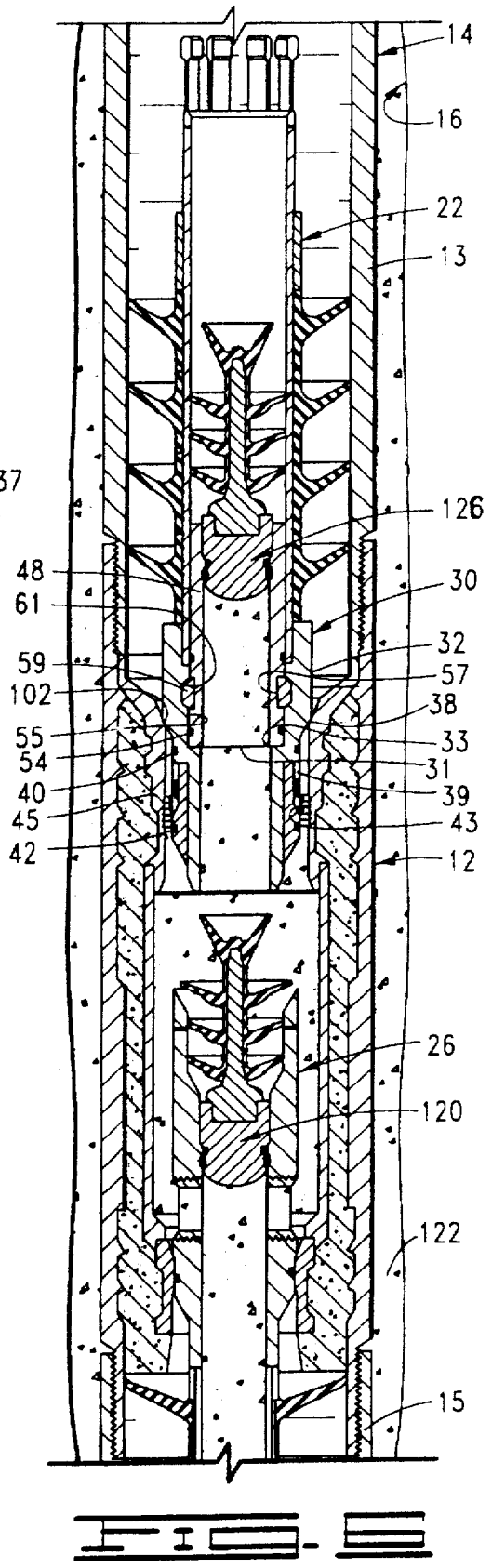

Positioned below the insert 106 and spaced therefrom by a metal cylinder 110 is a second smaller drillable metal insert 112 which forms the bottom annular seating surface 104. The annular seating surface 104 is of a size which engages the external annular seating surface 82 of the bottom cementing plug 26 as shown in FIG. 4.

Operation of the Apparatus 10 and 12

Referring now to FIGS. 1–6, the operation of the apparatus 10 and 12 and the method of using the apparatus 10 and 12 in accordance with the present invention for cementing a pipe string in a well bore are as follows. After the well bore 16 is drilled, the pipe string 14 to be cemented is run therein. During the running of the pipe string 14, the cementing plug seat member 12 is threadedly connected near the bottom end thereof, preferably between the bottom pipe joint 15 in the pipe string 14 and the next adjacent pipe joint 13 therein as shown in FIG. 2. As mentioned above, at the completion of the running of the pipe string 14, both the well bore 16 and the pipe string 14 are normally filled with drilling fluid 20.

The top and bottom cementing plug assembly 10 described above is next releasably connected to a circulation tool, casing running tool or the like 18 disposed in the top of the pipe string 14 as shown in FIG. 1.

Figure 3:
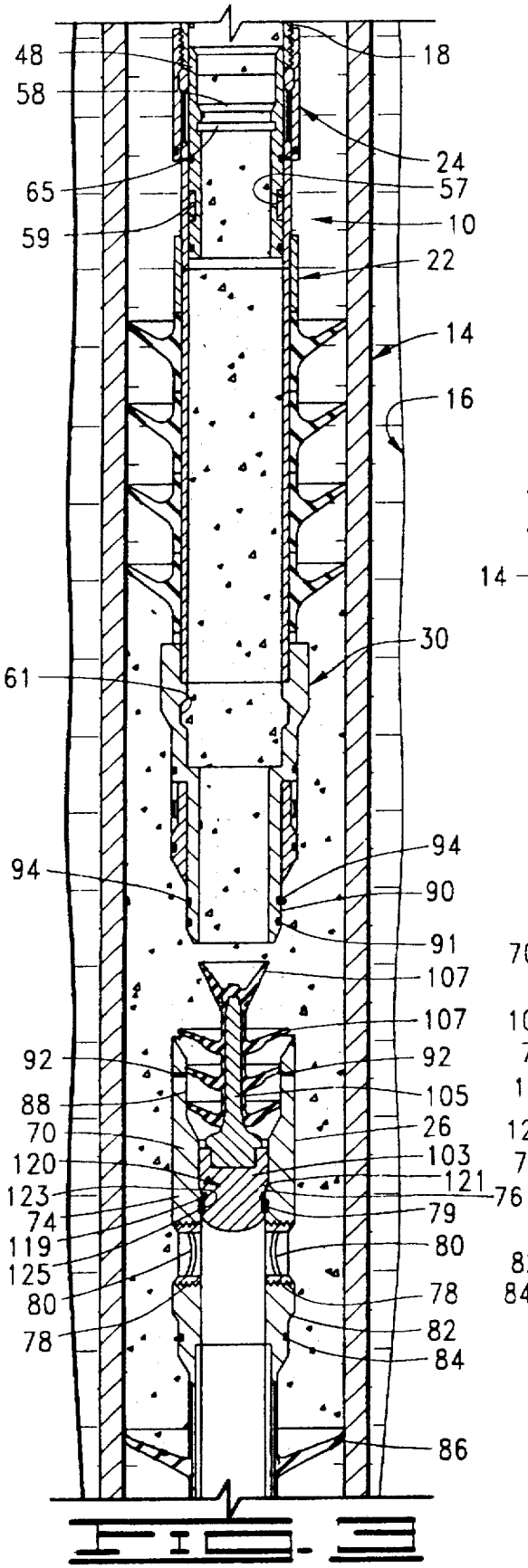
FIG. 3 is a cross-sectional view similar to FIG. 1 showing the cementing plug assembly after the release of the bottom cementing plug.
Figure 3A:
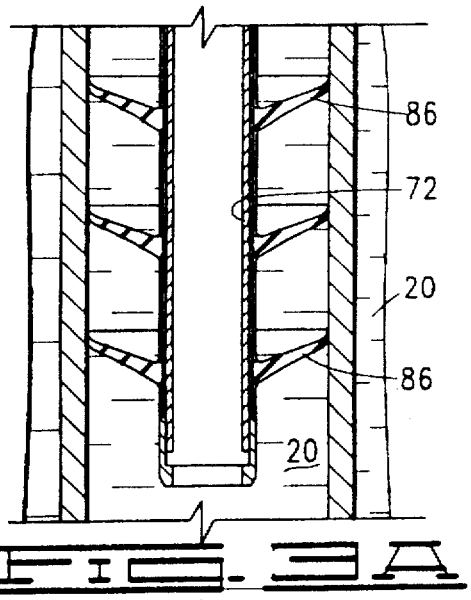

Referring now to FIG. 3, after circulating fluid through the pipe string 14 and the annulus between the pipe string and the walls of the well bore to clean the annulus, a first releasing plug 120 is dropped into the cementing plug assembly 10. As mentioned, the releasing plug 120 can take various forms such as a drill pipe plug or a ball, but preferably the releasing plug 120 is a drill pipe plug, i.e., it includes a nose portion 103 in the form of a plug and a tail portion 105 which includes a plurality of flexible wiper members 107 attached thereto extending upwardly and outwardly as shown in FIG. 3. The releasing plug 120 is of a size such that it passes through the internal annular seat 58 of the releasing sleeve 48 and seats on the internal annular seat 76 of the bottom cementing plug 26 as also shown in FIG. 3. The nose portion 103 of the releasing plug 120 includes an outer annular seat 121 which is complimentary to and engages the annular seat 76 of the bottom cementing plug 26. Positioned below the seat 121 is an annular groove 123 which has a compressible latch ring 125 disposed therein. As previously mentioned, the tubular body member 70 of the bottom cementing plug 26 includes an internal annular groove 79 therein which is complimentary to the annular groove 123 of the releasing plug 120. Thus, when the annular seat 121 of the releasing plug 120 seats on the annular seat 76 of the cementing plug 26, a portion of the latch ring 125 (which is compressed as it enters the reduced diameter portion of the tubular body member 70 below the seat 76) snaps into the groove 79 and latches the releasing plug 120 in the tubular body member 70. As will be understood, a variety of other latching mechanisms known to those skilled in the art can be utilized other than the snap ring mechanism described above.

When the releasing plug 120 seats on the annular seat 76, it closes the tubular body member 70 of the bottom cementing plug 26. In order to provide a seal between the tubular body member 70 and the releasing plug 120, the releasing plug 120 includes an outer annular groove 119 containing a seal ring. The bottom cementing plug 26 is then released by pumping a cement slurry 122 into the assembly 10 whereby the differential fluid pressure exerted on the closed bottom cementing plug 26 equals or exceeds the predetermined fluid pressure required to shear the shear pins 92.

The cement slurry 122 is pumped behind the bottom cementing plug 26 thereby displacing it through the pipe string 14 and partially through the cementing plug seat member 12 whereby the external annular seating surface 82 of the bottom cementing plug 26 engages the bottom internal annular seating surface 104 of the cementing plug seat member 12 as shown in FIG. 4. The portion of the bottom cementing plug 26 below the external annular seating surface 82 thereon is of a size and shape such that it passes through the bottom internal annular seating surface 104 and through the insert 112 of the cementing plug seat member 12. That is, as the leading portion 72 of the bottom plug 26 is forced through the interior of the seat member 12, the flexible wipers 86 each fold upwardly and pass through the restrictions therein. The part of the tail portion 74 of the bottom plug 26 preceding the annular seating surface 82 thereon enters the interior of the insert 112 below the annular seating surface 104 thereof and the groove/seal ring 84 provides a seal between the tail portion 74 and the insert 112.

The bottom cementing plug 26 is next opened whereby the cement slurry 122 is allowed to flow into the annulus 124 between the outside surfaces of the pipe string 14 and the walls of the well bore 16. This is accomplished by continuing the pumping of the cement slurry 122 after the bottom plug 26 seats in the cementing plug seat member 12 to raise the differential fluid pressure exerted on the rupturable members 80 of the bottom plug 26 until the differential fluid pressure equals or exceeds the predetermined fluid pressure required to rupture one or both of the rupturable members 80. When such rupture occurs, the cement slurry 122 flows into the portion of the tubular body member 70 below the annular seat 76 and releasing plug 120, through the pipe string 14 below the bottom plug 26 and into the annulus 124, all as shown in FIG. 4.

Referring now to FIG. 5, when the required quantity of the cement slurry 122 is pumped into the pipe string 14, a second releasing plug 126 is dropped into the top cementing plug 22. The releasing plug 126 can also take various forms, but preferably is in the form of a drill pipe plug as shown.

That is, the releasing plug 126 includes a nose portion 127 in the form of a plug and a tail portion 129 having flexible wiper members 131 attached thereto. The nose portion 127 of the releasing plug 126 includes an outer annular seat 133 which is complimentary to and engages the annular seat 58 of the top cementing plug 22. Positioned below the seat 133 is an annular groove 135 which includes a compressible latch ring 137. Like the releasing plug 120 previously described, when the releasing plug 126 lands on the annular seat 58 of the top cementing plug 22, a portion of the latch ring 137 snaps into the groove 65 in the collet 48 of the top cementing plug 22.

An outer annular groove 139 containing a seal ring provides a seal between the releasing plug 126 and the top cementing plug 22, and the top cementing plug 22 is closed by the releasing plug 126.

The top cementing plug 22 is next released by pumping a displacement fluid, such as additional drilling fluid 20, into the top cementing plug 22 whereby the differential fluid pressure exerted on the releasing sleeve 48 equals or exceeds the predetermined fluid pressure required to shear the shear pins 50. When the shear pins 50 shear, the releasing sleeve 48 is moved to a lower position as shown in FIG. 5. When the releasing sleeve 48 reaches the lower position, the heads 47 of the collet 46 are moved inwardly whereby the collet 46 moves downwardly out of engagement with the collet retaining sleeve 62 and the top cementing plug 22 is released. The displacement fluid, i.e., the drilling fluid 20, is pumped behind the top cementing plug 22 whereby it and the cement slurry 122 ahead of it are displaced through the pipe string 14.

Referring now to FIG. 6, the cement slurry 122 ahead of the top cementing plug 22 is displaced through the pipe string 14, through the cementing plug seat member 12 and through the bottom cementing plug 126 into the annulus 124. When the top cementing plug 22 reaches the seat member 12, the external annular seating surface 38 on the top cementing plug 22 seats on the top internal annular seating surface 102 of the seat member 12 as shown in FIG. 6. The grooves/seal rings 40 and 42 on the leading portion 32 of the top plug 22 provide seals between the insert 106 of the seat member 12 and the top plug 22. Further, the upwardly facing ratchet shoulders 43 of the collet 39 attached to the leading portion 32 of the top plug 22 engage the downwardly facing ratchet shoulders 45 in the funnel shaped sleeve 106 of the seat members 12 whereby the top plug 22 is latched to the seat member 12. The fastening of the top cementing plug 22 to the seat member 12 in combination with the fastening of the releasing plug 126 to the top cementing plug 22 provides a positive shutoff of the pipe string 14 from the annulus 124 thereby preventing the reverse flow of the cement slurry 122 into the pipe string 14 after the top cementing plug 22 lands on the seat member 12.

In order to pressure test the pipe string 14 and the other equipment associated therewith after the top plug 22 has landed on the seat member 12, the pumping of the displacement fluid, i.e., the drilling fluid 20, behind the top plug 22 is continued to raise the pressure of the displacement fluid in the pipe string 14. As the pressure of the drilling fluid 20 is increased, the releasing sleeve 48 and the releasing plug 26 latched thereto are forced downwardly through the intermediate portion 34 of the tubular member 30 of the top cementing plug 22 into the leading portion 32 thereof as shown in FIG. 6. When the bottom end 31 of the releasing sleeve 48 lands on the upwardly facing shoulder 33 provided in the interior of the leading portion 32 of the cementing plug 22, the latch ring 59 in the groove 57 of the releasing sleeve 48 snaps into the groove 61 in the leading portion 32 thereby latching the releasing sleeve 48 in the leading portion 32. As mentioned, the seal ring 54 provides a seal between the releasing sleeve 48 and the interior of the leading portion 32.

Since the top cementing plug 22 is sealingly seated on the top annular seating surface 102 of the seat member 12, the increased pressure is not communicated to the bottom plug 26 or the portion of the seat member 12 below the internal annular seating surface 102 thereof. Further, the releasing sleeve 48 and the releasing plug 126 are sealingly latched in the leading portion 32 of the cementing plug 22. Thus, only the leading portion 32 of the top cementing plug 22 is subjected to high pressure during pressure tests which reduces the possibility of failures or leaks and the need for the use of expensive high strength materials.

Following the pressure test, the cement slurry 122 in the annulus is allowed to set into a hard mass. Thereafter, if desirable, the top and bottom cementing plugs 22 and 26 and the internals of the cementing plug seat member 12 can be drilled out of the pipe string 14.

As will now be understood by those skilled in the art, the tubular body members 30 and 70 of the top and bottom plugs 22 and 26, respectively, can be utilized in various sizes of pipe by simply changing the sizes of the resilient wipers 44 and 86 to sizes which corresponds to the pipe size. The sizes of the internal annular seating surfaces 102 and 104 of the inserts 106 and 112 in the cementing plug seat member 12 can remain the same.

Alternate Embodiment of the Apparatus

Figure 7:
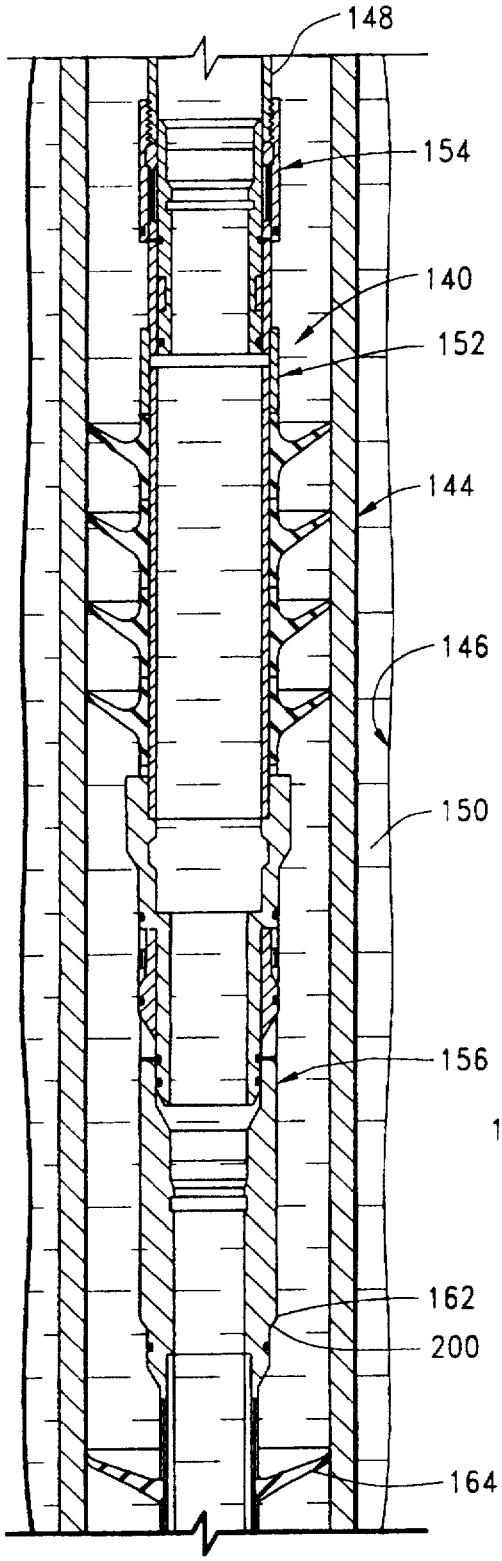
FIG. 7 is a side cross-sectional view of a well bore and a string of pipe to be cemented therein having the cementing plug assembly of an alternate embodiment of the present invention installed in its initial position in the string of pipe.
Figure 8:
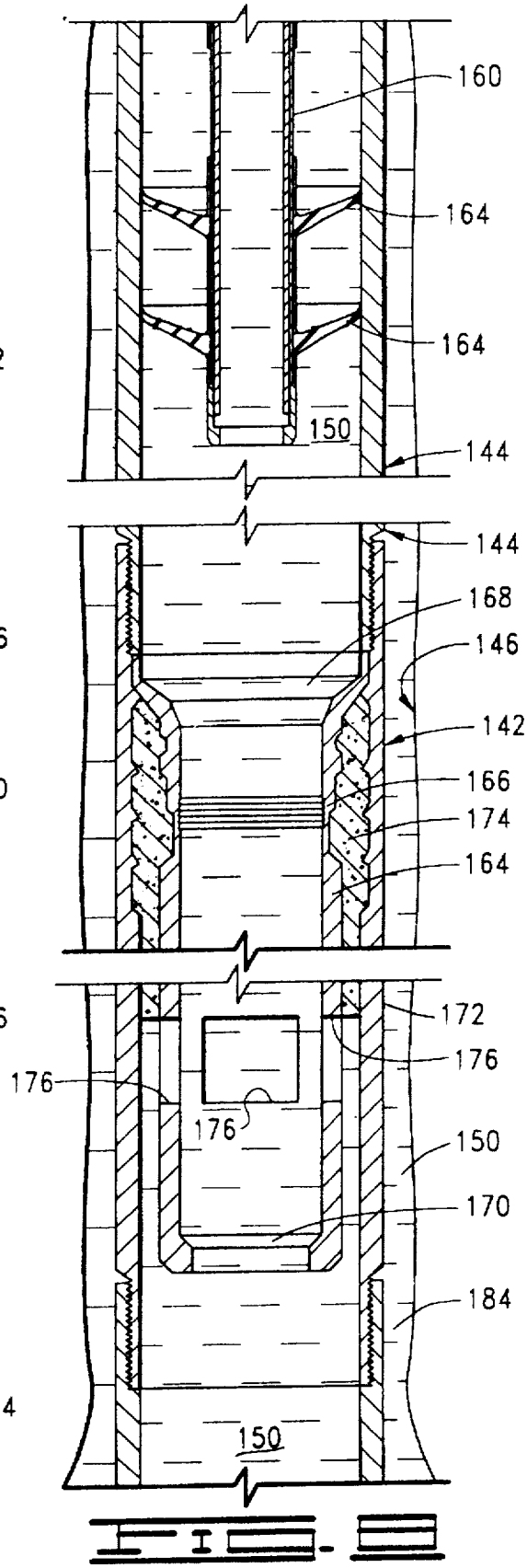
FIG. 8 is a side cross-sectional view similar to FIG. 7 showing a portion of the string of pipe near the bottom end thereof having the cementing plug seat member of the alternate embodiment of the present invention connected in the string of pipe.
Figure 9:
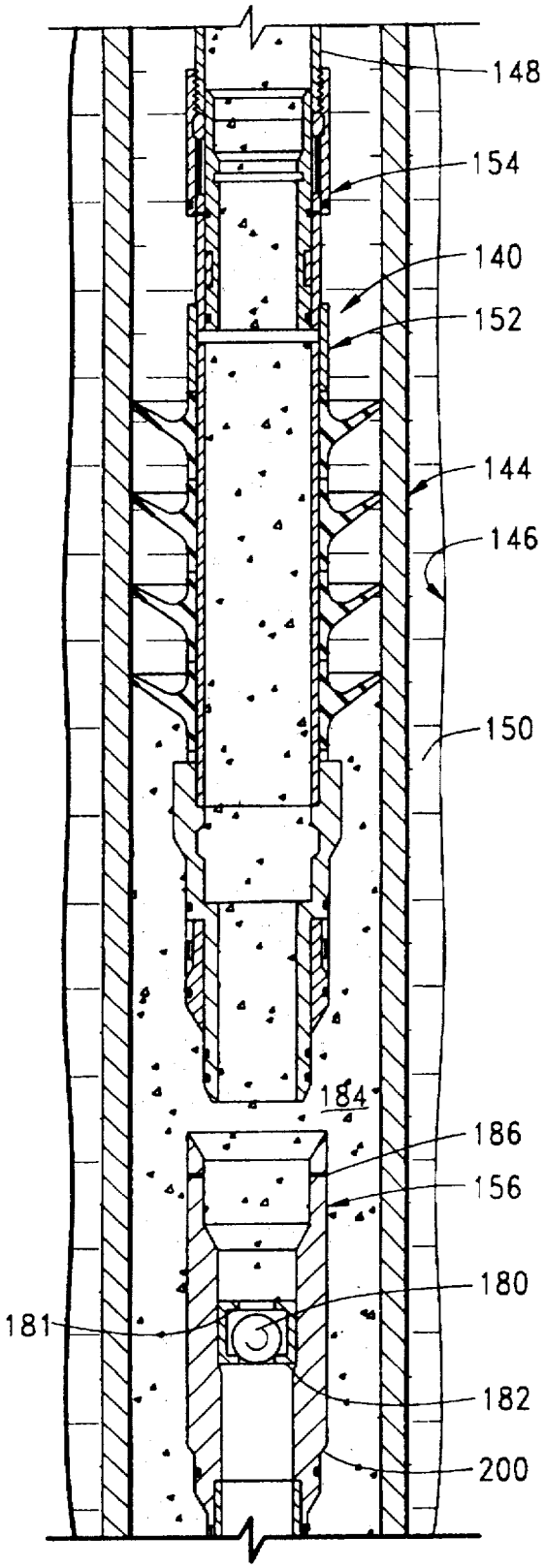
FIG. 9 is a cross-sectional view similar to FIG. 7 showing the cementing plug assembly after the bottom cementing plug has been released.

Referring now to FIGS. 7–12, an alternate embodiment of the apparatus of the present invention is illustrated as is the method of using the apparatus. Referring specifically to FIGS. 7 and 8, the improved subsurface release cementing plug apparatus of the alternate embodiment is illustrated. The apparatus is comprised of a top and bottom cementing plug assembly generally designated by the numeral 140 in FIG. 7, and a cementing plug seat member, generally designated by the numeral 142 in FIG. 8.

The cementing plug assembly 140 is shown positioned within the top portion of a string of pipe 144 which is to be cemented in a well bore 146. The cementing plug assembly 140 is releasably connected to the lower end of a circulation tool, a casing running tool or the like, designated by the numeral 148.

In FIG. 8, a portion of the pipe string 144 near the bottom end thereof is shown in the well bore 146. The cementing plug seat member 142 of the alternate embodiment is illustrated connected in the pipe string 144. Both the pipe string 144 and the well bore 146 are filled with drilling fluid 150.

As shown in FIG. 7, the cementing plug assembly 140 is comprised of a top cementing plug 152 connected to the circulation tool or casing running tool 148 by a releasable connecting assembly 154, and a bottom cementing plug 156 releasably connected to the top cementing plug 152 by a releasable connecting assembly 158.

The top cementing plug 152 is identical to the top cementing plug 22 previously described, and the releasable connecting assembly 154 is identical to the connecting assembly 24 previously described. Similarly, the releasable connecting assembly 158 connecting the bottom cementing plug 156 to the top cementing plug 152 is identical to the connecting assembly 28 previously described.

The bottom cementing plug 156 is similar to the bottom cementing plug 26 except that the bottom cementing plug 156 does not include the lateral ports 78, the rupturable members 80 or the groove/seal ring 84 as does the bottom cementing plug 26. Further, the leading portion 160 of the bottom cementing plug 156 is longer than the leading portion 72 of the bottom cementing plug 26, and the bottom cementing plug 156 includes four flexible wipers 164 attached to the leading portion 160 thereof. As shown in FIG. 7, the top pair of flexible wipers 164 are spaced a distance from the bottom pair of flexible wipers 164 as will be further described below.

Referring now to FIG. 8, the cementing plug seat member 142 is identical to the previously described cementing plug seat member 12 except that the seat member 142 includes a single insert 166 which includes spaced apart top and bottom annular seating surfaces 168 and 170, respectively, and a plurality of ratchet shaped teeth which provide downwardly facing shoulders 169 thereon for latching to the top cementing plug 22. The insert 166 is disposed within a pipe section 172 connected between adjacent pipe joints in the pipe string 144. The top annular seating surface 168 is larger than the bottom annular seating surface 170, and the insert 166 is held in the pipe section 172 by a readily drillable cement composition 174 or the like. The basic difference between the seat member 142 and the previously described seat member 12 is that the seat member 142 includes one or more (three are shown) lateral ports 176 in the insert 164 which provide flow passages from the interior of the insert 164 to the exterior thereof and to the interior of the pipe string 144 below the seat member 142.

Operation of the Apparatus 140 and 142

Referring now to FIGS. 7–12, the operation of the apparatus 140 and 142 and the method of using the apparatus are similar to the operation of the apparatus 10 and 12 previously described. That is, after the well bore 146 is drilled, the pipe string 144 to be cemented is run therein. During the running of the pipe string 144 the cementing plug seat member 142 is threadedly connected near the bottom end thereof as shown in FIG. 8.

The top and bottom cementing plug assembly 140 is releasably connected to a circulation tool or casing running tool 148 disposed in the top of the pipe string 144 as shown in FIG. 7. After the annulus 184 is cleaned by the circulation of drilling or other fluid therethrough, the bottom cementing plug 156 is closed and released in the same manner as described above in connection with the bottom cementing plug 26 of the assembly 10. That is, referring to FIG. 9, a first releasing plug 180 is dropped into the cementing plug assembly 140 which seats on an internal annular seat 182 in the bottom cementing plug 156 thereby closing the bottom cementing plug 156. The first releasing plug 180 is shown in the form of a ball instead of a drill pipe plug. When a ball 180 is utilized, a sleeve 181 formed of resilient material is bonded within the interior of the bottom cementing plug 156 above the annular seat 182 for retaining the ball 180 in the bottom cementing plug 156. A cement slurry 184 is then pumped into the assembly 140 whereby the differential fluid pressure exerted on the closed bottom cementing plug 156 equals or exceeds the predetermined fluid pressure required to shear the shear pins 186 connected between the bottom cementing plug 156 and the top cementing plug 152.

The cement slurry 184 is pumped behind the bottom cementing plug 156 thereby displacing it through the pipe string 144 and partially through the cementing plug seat member 142 whereby the bottom cementing plug 156 seats on the bottom annular seating surface 170 of the seat member 142. The extra space between the top and bottom pairs of flexible wipers 164 attached to the bottom cementing plug 156 helps the portion of the bottom cementing plug 156 below the external annular seating surface 200 thereon to pass through the seat member 142 and bottom seating surface 170 thereof. That is, as the bottom cementing plug 156 passes through the seat member 142, there is always a fully expanded flexible wiper positioned either above or below the seat member 142 to push or pull the bottom plug 156 through the seat member 142.

Figure 10:
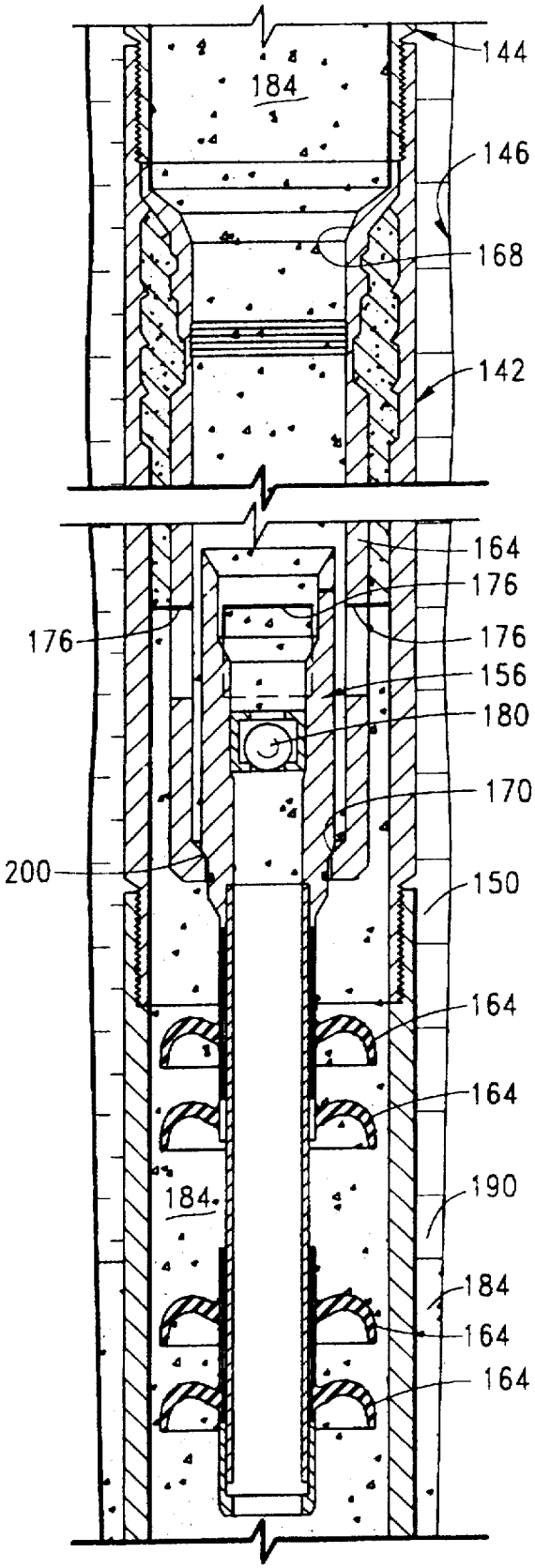
FIG. 10 is a side cross-sectional view similar to FIG. 8 showing the cementing plug seat member after the bottom cementing plug has seated therein and after the flexible wipers thereof have inverted and been bypassed.

The bottom cementing plug 156 is next opened by continuing the pumping of the cement slurry 184 through the top plug 152 and into the pipe string 144. Instead of rupturable members which rupture when the pressure of the cement slurry within the pipe string is increased as described above in connection with the apparatus 10 and 12, the flexible wipers 164 of the bottom cementing plug 156 are of a size and shape such that they invert and are bypassed when a predetermined differential fluid pressure is exerted on them. Thus, when the fluid pressure of the cement slurry 184 in the pipe string 144 is increased after the bottom plug 156 seats in the seat member 142, the fluid pressure is communicated by way of the lateral ports 176 in the insert 164 and the pipe string 144 below the seat member 142 on the flexible wipers 164 causing them to invert and to be bypassed whereby the cement slurry 184 flows into the annulus 190 as illustrated in FIG. 10.

Figure 11:
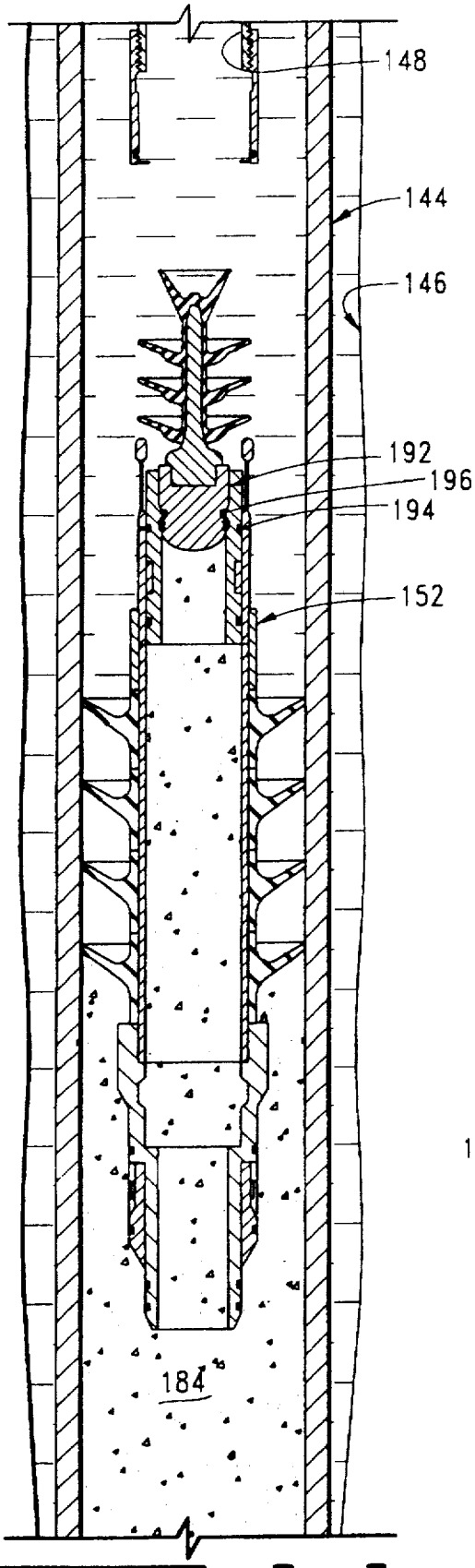
FIG. 11 is a side cross-sectional view similar to FIG. 7 showing the top cementing plug after it has been released.
Figure 12:
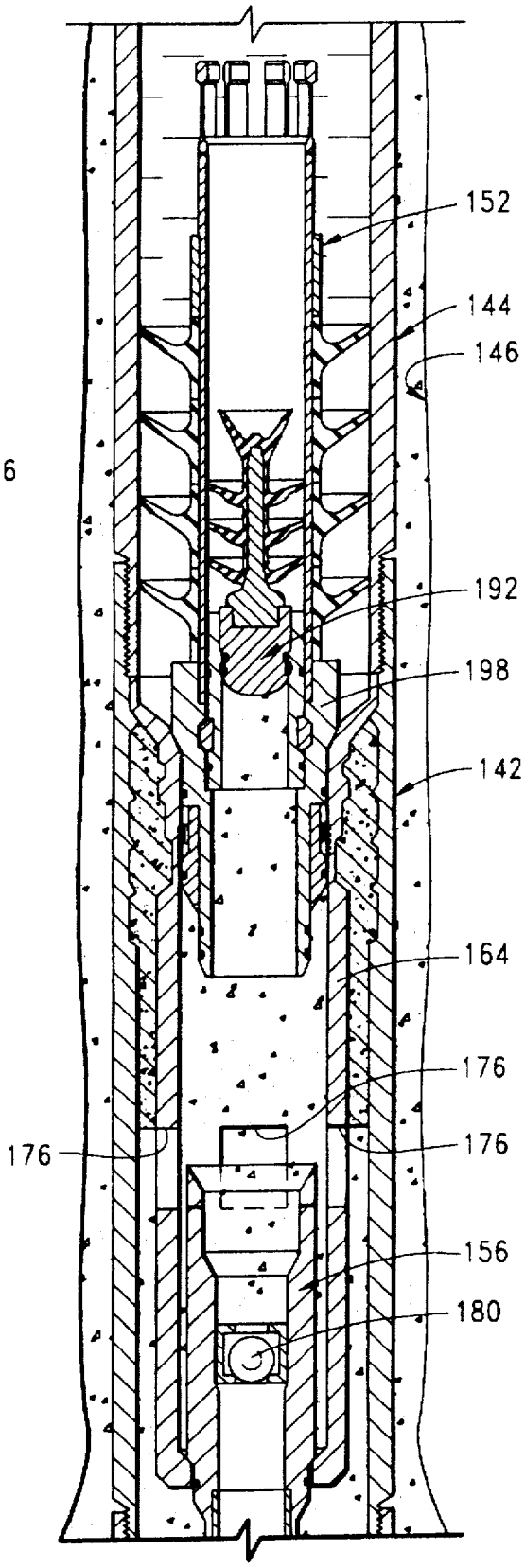
FIG. 12 is a side cross-sectional view similar to FIG. 8 showing the cementing plug seat member having the bottom cementing plug and the top cementing plug seated therein.

Referring now to FIG. 11, when the required quantity of the cement slurry 184 is pumped into the pipe string 144, a second releasing plug 192 (which is identical to the releasing plug 126 described above) is dropped into the top cementing plug 152. As described above in connection with the top cementing plug 22 of the assembly 10, the releasing plug 192 is preferably a drill pipe plug including latching means which latch to complimentary latch receiving means in the top cementing plug 152. When the releasing plug 192 seats on an annular seat 194 in the releasing sleeve of the collet connecting assembly 154 attached to the top cementing plug 152, the top cementing plug is closed and the releasing plug 192 is latched to the top cementing plug 152. The top cementing plug 152 is released by the pumping of a displacement fluid, such as additional drilling fluid 150, into the top cementing plug 152 whereby the shear pins 196 therein are sheared and the releasing sleeve is moved downwardly. The displacement fluid is pumped behind the top cementing plug 152 whereby it and the cement slurry 184 ahead of it are displaced through the pipe string 144. When the top cementing plug 152 seats in and is latched to the cementing plug seat member 142 as shown in FIG. 12, the releasing sleeve of the top cementing plug 152 and the releasing plug 192 are moved downwardly into latching engagement with the leading portion 198 of the top plug 152 and the pipe string 144 is pressure tested as described above in connection with the apparatus 10 and 12.

Thus, the present invention is well adapted to carry out the objects and attain the benefits and advantages mentioned as well as those which are inherent therein. While numerous changes to the apparatus and methods can be made by those skilled in the art, such changes are encompassed within the spirit of this invention as defined by the appended claims.

What is claimed is:

1. An improved subsurface release cementing plug apparatus for use in a string of pipe during the cementing of the pipe in a well bore comprising:

a hollow cementing plug seat member adapted to be connected in said string of pipe near the bottom thereof including internal spaced apart top and bottom annular seating surfaces and a latch receiving means positioned adjacent to said top annular seating surface, said top annular seating surface being larger than said bottom annular seating surface;

an open, selectively closable, top cementing plug releasably connectable to a circulation tool or casing running tool having an external annular seating surface formed thereon near the lower end thereof for sealingly engaging said top internal annular seating surface of said cementing plug seat member and having latch means attached thereto for fastening said top cementing plug to said latch receiving means of said cementing plug seat member; and an open, selectively closable and reopenable, bottom cementing plug releasably connected to said top cementing plug having an external annular seating surface formed thereon near the upper end thereof for sealingly engaging said bottom internal annular seating surface of said cementing plug seat member, the portion of said bottom cementing plug below said external annular seating surface thereon being of a size and shape such that said portion passes through said bottom interior annular seating surface of said cementing plug seat assembly.

2. The apparatus of claim 1 wherein said bottom cementing plug further comprises a tubular body member having an internal annular seat therein for receiving a first releasing plug that closes said tubular body member and a plurality of flexible wipers attached thereto extending outwardly and upwardly from said tubular body member.

3. The apparatus of claim 2 wherein said tubular body member of said bottom plug further comprises at least one lateral port positioned between said internal annular seat therein and said external annular seating surface thereon and a rupturable member which ruptures at a predetermined differential fluid pressure sealingly disposed in said lateral port.

4. The apparatus of claim 2 wherein said cementing plug seat member further comprises at least one lateral port positioned between said top and bottom internal annular seating surfaces and opening into said string of pipe below said seat member, and said bottom cementing plug flexible wipers are of a size and shape such that they invert and are bypassed when a predetermined differential fluid pressure is exerted thereon.

5. The apparatus of claim 3 or 4 wherein said top cementing plug further comprises a tubular body member including an internal annular seat for receiving a second releasing plug that closes said tubular body member and a plurality of flexible wipers attached thereto extending outwardly and upwardly from said tubular body member, said internal annular seat of said top cementing plug being larger than said internal annular seat of said bottom cementing plug.

6. The apparatus of claim 5 wherein said bottom cementing plug is releasably connected to said top cementing plug by shearable means which shear and release said bottom plug when a predetermined differential fluid pressure is exerted thereon after said bottom plug is closed by a releasing plug.

7. The apparatus of claim 6 wherein said shearable means comprise one or more shear pins.

8. The apparatus of claim 6 wherein said top cementing plug is releasably connectable to said circulation tool or casing running tool by shearable means which shear and release said top cementing plug when a predetermined differential pressure is exerted thereon after said top cementing plug is closed by a releasing plug.

9. The apparatus of claim 8 wherein said shearable means comprise one or more shear pins connected between said drill string or circulation tool and said top cementing plug.

10. The apparatus of claim 8 wherein said shearable means comprise:

a collet retaining sleeve connected to said circulation tool or casing running tool;

a collet connected to said tubular body member of said top cementing plug for engaging said collet retaining sleeve;

a collet releasing sleeve slidably disposed within said collet for maintaining said collet in engagement with said collet retaining sleeve when in an upper position and for releasing said collet when in a lower position, said collet releasing sleeve including said internal annular seat for receiving a releasing plug that closes said tubular body member of said top cementing plug; and one or more shear pins connected between said collet and said collet releasing sleeve for maintaining said releasing sleeve in its upper position until a releasing plug closes said releasing sleeve and a predetermined differential fluid pressure is exerted on said closed releasing sleeve which shears said shear pin or pins and moves said releasing sleeve to its lower position.

11. The apparatus of claim 5 which further comprises:

said first releasing plug including a latch means attached thereto for latching said plug to said tubular body member of said bottom cementing plug; and said tubular body member of said bottom cementing plug including latch receiving means for receiving said latch means of said first releasing plug and fastening said plug to said tubular member when said plug seats on said internal annular seat thereof whereby said releasing plug prevents reverse flow of fluids through said tubular body member.

12. The apparatus of claim 11 wherein said latch means attached to said releasing plug comprises an outer annular groove formed in a leading outer surface of said releasing plug and a compressible latch ring disposed in said groove.

13. The apparatus of claim 12 wherein said latch receiving means of said tubular body member comprises an inner annular groove complimentary to said outer annular groove of said releasing plug disposed in said tubular body member for receiving a portion of said latch ring therein.

14. The apparatus of claim 5 which further comprises:

said second releasing plug including a latch means attached thereto for latching said plug to said tubular body member of said top cementing plug; and said tubular body of said top cementing plug including latch receiving means for receiving said latch means of said second releasing plug and fastening said plug to said tubular member when said plug seats on said internal annular seat thereof whereby said releasing plug prevents reverse flow of fluids through said tubular body member.

15. The apparatus of claim 14 wherein said latch means attached to said releasing plug comprises an outer annular groove formed in a leading outer surface of said releasing plug and a compressible latch ring disposed in said groove.

16. The apparatus of claim 15 wherein said latch receiving means of said tubular body member comprises an inner annular groove complimentary to said outer annular groove of said releasing plug disposed in said tubular body member for receiving a portion of said latch ring therein.

17. A method of cementing a string of pipe in a well bore by way of a circulation tool or casing running tool disposed within the top of said string of pipe comprising the steps of:

(a) connecting in said string of pipe near the bottom thereof a hollow cementing plug seat member which includes internal spaced apart top and bottom annular seating surfaces and a latch receiving means positioned adjacent to said top annular seating surface, said top annular seating surface being larger than said bottom annular seating surface;

(b) connecting a top and bottom cementing plug assembly to said circulation tool or casing running tool, said assembly comprising:

an open, selectively closable, top cementing plug releasably connectable to said drill string or circulation tool having an external annular seating surface formed thereon near the lower end thereof for sealingly engaging said top internal annular seating surface of said cementing plug seat member and having latch means attached thereto for fastening said top cementing plug to said latch receiving means of said cementing plug seat member; and an open, selectively closable and reopenable, bottom cementing plug releasably connected to said top cementing plug having an external annular seating surface formed thereon near the upper end thereof for sealingly engaging said bottom internal annular seating surface of said cementing plug seat member, the portion of said bottom cementing plug below said external annular seating surface thereon being of a size and shape such that said portion passes through said bottom interior annular seating surface of said cementing plug seat assembly;

(c) closing and releasing said bottom cementing plug into said string of pipe;

(d) pumping a cement slurry behind said bottom cementing plug whereby said bottom cementing plug is displaced through said string of pipe and partially through said cementing plug seat member whereby said external annular seating surface of said bottom plug sealingly engages said bottom internal annular seating surface of said cementing plug seat member;

(e) reopening said bottom plug whereby said cement slurry is allowed to flow into the annulus between the outside surfaces of said pipe and said well bore;

(f) closing and releasing said top cementing plug into said string of pipe;

(g) pumping a displacement fluid behind said top cementing plug whereby said top cementing plug is displaced through said string of pipe and into said cementing plug seat member whereby said external annular seating surface of said top plug sealingly engages said top internal annular seating surface of said seat member and said top plug latch means engage said latch receiving means of said seat member. said cement slurry being displaced into said annulus;

(h) continuing the pumping of said displacement fluid to raise the pressure in said string of pipe above said cementing plug seat member to thereby pressure test said string of pipe; and (i) allowing said cement slurry to set in said annulus.

18. The method of claim 17 wherein said bottom cementing plug is releasably connected to said top cementing plug by shearable means which shear when a predetermined differential pressure is exerted thereon.

19. The method of claim 18 wherein said shearable means comprises at least one shear pin.

20. The method of claim 18 wherein said bottom cementing plug includes a tubular body member having an internal annular seat for receiving a releasing plug that closes said tubular body member and a plurality of flexible wipers attached thereto extending outwardly and upwardly from said tubular body member.

21. The method of claim 20 wherein closing and releasing said bottom cementing plug in accordance with step (c) comprises:

dropping a first releasing plug into said cementing plug assembly having a size whereby said first releasing plug sealingly seats on said internal annular seat of said bottom cementing plug tubular body member thereby closing said bottom cementing plug; and pumping said cement slurry into said cementing plug assembly whereby the differential fluid pressure exerted on said closed bottom cementing plug equals or exceeds the predetermined fluid pressure required to shear said shearable means connecting said bottom cementing plug to said top cementing plug.

22. The method of claim 21 wherein said cementing plug seat member further includes at least one lateral port positioned between said top and bottom annular seating surfaces and opening into said string of pipe below said seat member, and said bottom plug flexible wipers are of a size and shape such that they invert and are bypassed when a predetermined differential fluid pressure is exerted thereon.

23. The method of claim 22 wherein reopening said bottom cementing plug in accordance with step (e) comprises continuing pumping said cement slurry whereby said differential fluid pressure exerted on said bottom cementing plug by way of said lateral port in said cementing plug seat member equals or exceeds said predetermined differential fluid pressure required to invert and bypass said bottom plug flexible wipers.

24. The method of claim 21 wherein said tubular body member of said bottom plug further includes:

at least one lateral port positioned between said internal annular seat therein and said external annular seating surface thereon; and a rupturable member which ruptures at a predetermined differential fluid pressure sealingly disposed in said lateral port.

25. The method of claim 24 wherein reopening said bottom cementing plug in accordance with step (e) comprises rupturing said rupturable member by continuing pumping said cement slurry whereby said differential fluid pressure exerted on said rupturable member equals or exceeds the predetermined fluid pressure required to rupture said rupturable member.

26. The method of claims 25 or 23 wherein said top plug further comprises a tubular body member including an internal annular seat for receiving a releasing plug that closes said tubular body member and a plurality of flexible wipers attached thereto extending outwardly and upwardly from said tubular body member, said internal annular seat of said top cementing plug being larger than said internal annular seat of said bottom cementing plug.

27. The method of claim 26 wherein said top cementing plug is releasably connectable to said circulation tool or casing running tool by shearable means which shear and release said top cementing plug when a predetermined differential pressure is exerted thereon after said top cementing plug is closed by a releasing plug.

28. The method of claim 27 wherein said shearable means comprises one or more shear pins connected between said circulation tool or casing running tool and said top cementing plug.

29. The method of claim 27 wherein closing and releasing said top cementing plug in accordance with step (f) comprises:

dropping a second releasing plug into said top cementing plug having a size whereby said second releasing plug sealingly seats on said internal annular seat of said top cementing plug tubular body member thereby closing said top cementing plug; and pumping said displacement fluid into said closed top cementing plug whereby the differential fluid pressure exerted thereon equals or exceeds the predetermined fluid pressure required to shear said shearable means connecting said top cementing plug to said circulation tool or casing running tool thereby releasing said top plug.

30. The method of claim 27 wherein said shearable means comprise:

a collet retaining sleeve connected to said circulation tool or casing running tool;

a collet attached to said tubular body member of said top cementing plug for engaging said collet retaining sleeve;

a collet releasing sleeve slidably disposed within said collet for maintaining said collet in engagement with said collet retaining sleeve when in an upper position and for releasing said collet when in a lower position, said collet releasing sleeve including said internal annular seat for receiving a releasing plug that closes said tubular body member of said top cementing plug; and one or more shear pins connected between said collet and said collet releasing sleeve for maintaining said releasing sleeve in its upper position until a releasing plug closes said releasing sleeve and a predetermined differential fluid pressure is exerted on said closed releasing sleeve.

31. The method of claim 30 wherein closing and releasing said top cementing plug comprises:

dropping a second releasing plug into said top cementing plug having a size whereby said second releasing plug sealingly seats on said internal annular seat of said releasing sleeve thereby closing said top cementing plug; and pumping said displacement fluid into said closed top cementing plug whereby the differential fluid pressure exerted on said closed releasing sleeve equals or exceeds the predetermined fluid pressure required to shear said shear pins and move said releasing sleeve to its lower position thereby releasing said top cementing plug.

32. The method of claim 31 wherein said second releasing plug includes a latch means attached thereto for latching said plug to said tubular body member of said top cementing plug, and said tubular body member of said top cementing plug includes latch receiving means for receiving said latch means of said second releasing plug and fastening said plug to said tubular body member when said plug seats on said internal annular seat thereof whereby said second releasing plug prevents reverse flow of fluids through said tubular body member.

33. The method of claim 32 wherein said releasing sleeve of said top cementing plug is moved downwardly in said top cementing plug during step (h) and further includes an outer latch means for latching said releasing sleeve to an inside surface of a lower portion of said tubular body member of said top cementing plug, and said lower portion of said tubular body member further includes internal latch receiving means for receiving said latch means of said releasing sleeve and fastening said releasing sleeve to said lower portion of said tubular body member.

34. The method of claim 32 wherein said latch means attached to said releasing plug is comprised of an outer annular groove formed in a leading outer surface of said releasing plug and a compressible latch ring disposed in said groove.

35. The method of claim 34 wherein said latch receiving means of said tubular body member comprises an inner annular groove complimentary to said outer annular groove of said releasing plug disposed in said tubular body member for receiving a portion of said latch ring therein.

36. The method of claim 26 wherein said first releasing plug includes a latch means attached thereto for latching said plug to said tubular body member of said bottom cementing plug, and said tubular body member of said bottom cementing plug includes latch receiving means for receiving said latch means of said first releasing plug and fastening said plug to said tubular body member when said plug seats on said internal annular seat thereof whereby said first releasing plug prevents reverse flow of fluids through said tubular body member.

37. The method of claim 36 wherein said latch means attached to said releasing plug is comprised of an outer annular groove formed in a leading outer surface of said releasing plug and a compressible latch ring disposed in said groove.

38. The method of claim 37 wherein said latch receiving means of said tubular body member comprises an inner annular groove complimentary to said outer annular groove of said releasing plug disposed in said tubular body member for receiving a portion of said latch ring therein.

* * * * *